US005810638A

United States Patent [19]

Wood

[11] Patent Number: 5,810,638

[45] Date of Patent: Sep. 22, 1998

[54] LAND, AIR AND OUTERSPACE TOY VEHICLE

[75] Inventor: Wesley Wood, Cape Canaveral, Fla.

[73] Assignee: Angels of Today, Inc., Satellite Beach, Fla.

[21] Appl. No.: 642,585

[22] Filed: May 3, 1996

[51] Int. Cl.[6] ..... A63H 17/00

[52] U.S. Cl. ..... 446/73; 446/230; 446/470; 446/487

[58] Field of Search ..... 446/62, 66, 487, 446/230–232, 465, 470, 36, 37, 73

[56] References Cited

U.S. PATENT DOCUMENTS

| | | | |
|---|---|---|---|
| 2,272,643 | 2/1942 | Peters et al. | 446/470 X |
| 4,114,309 | 9/1978 | Gay | 446/232 |
| 4,244,144 | 1/1981 | Goldberg et al. | 446/470 X |
| 4,349,984 | 9/1982 | Goldfarb et al. | 446/139 X |
| 4,382,347 | 5/1983 | Murakami | 446/470 X |
| 4,467,556 | 8/1984 | Iwoa et al. | 446/230 |
| 4,500,299 | 2/1985 | Kelley et al. | 446/230 |
| 4,668,205 | 5/1987 | Choy et al. | 446/230 |
| 4,889,514 | 12/1989 | Auer et al. | 446/230 |
| 5,304,090 | 4/1994 | Vanni | 446/36 |

*Primary Examiner*—Robert A. Hafer
*Assistant Examiner*—Jeffrey D. Carlson
*Attorney, Agent, or Firm*—Law Offices of Brian S. Steinberger; Brian S. Steinberger

[57] ABSTRACT

A novel toy shuttle for simulating play on land, air and outer space. The shuttle body having retractable side wings each having spring loaded projectile launchers thereon. Retractable wheels are located beneath the shuttle body along with a trap door which has a pliable disc harness sized to fit about waists of bendable action figures. On top of the shuttle body are foldable and removable helicopter blades and a rear facing tail stabilizer propeller can be stored into the top of a slidable cover on the shuttle body. Beneath the slidable cover is a robot pilot compartment for magnetically supporting a robot pilot, and a crew compartment for seating the bendable action figures. The front of the shuttle body has a cockpit cover with a hinged lid where additional action figures can be positioned therein. Battery powered lights are located at the front and rear of the shuttle body. A piston operated water gun allows for water to be squirted from the front of the shuttle. A fold down tail gate is located at the rear of the shuttle body.

16 Claims, 15 Drawing Sheets

10
55
40
60
35
30

10
50
20
22
60
59
90
40
42

10
33
30
20
22
60
53
50
B
C
40
42

10
100
20
30
60
22
A

D

Fig. 3B
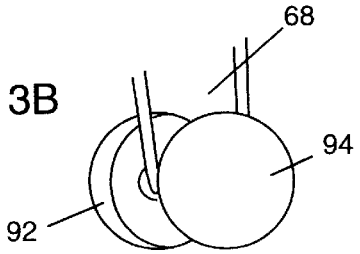
Fig. 3C
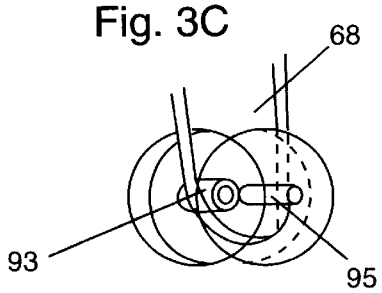
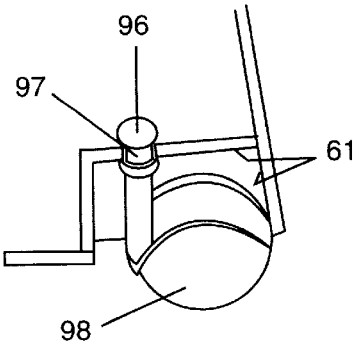
Fig. 3D
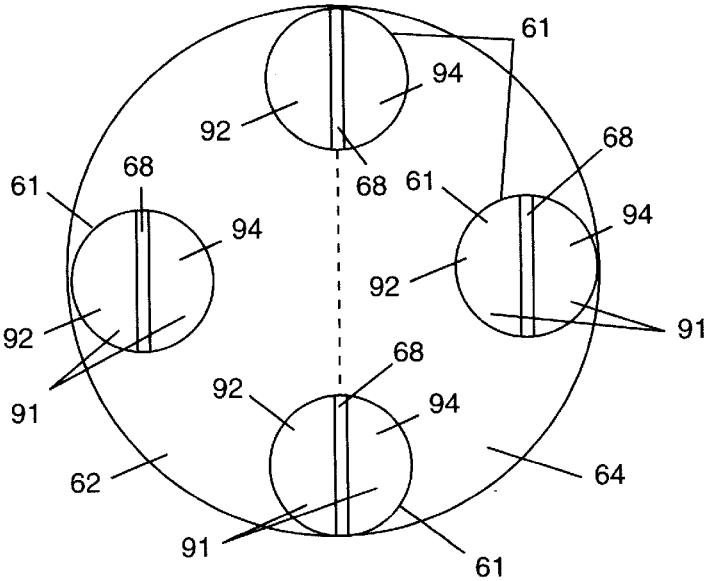
Fig. 3A 454
452
450
456
458
442
444
453
430
420
425

462
464
463
460
465
I3
I2
I1
244
240
242
K1
280
210
260
400

Fig. 8C
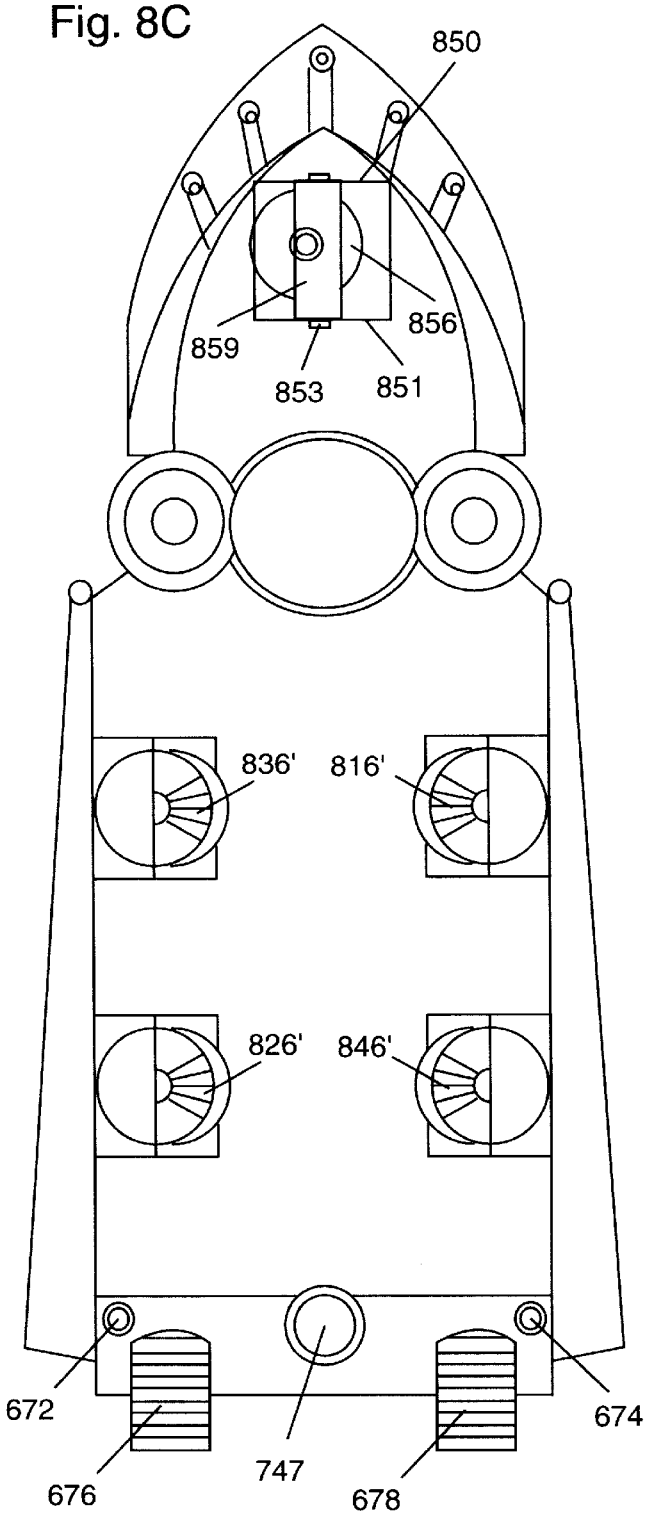
Fig. 8G
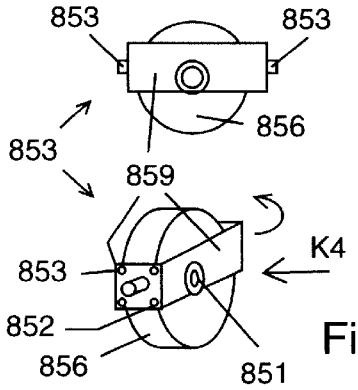
Fig. 8F
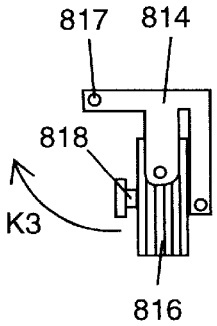
Fig. 8E
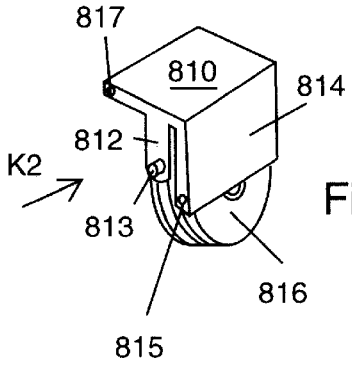
Fig. 8D

LAND, AIR AND OUTERSPACE TOY VEHICLE

This invention relates to a land, air and outerspace toy shuttle with action figures, and in particular to an toy vehicle with foldable wings and projectile launchers, sliding and hinged top covers, propellers, retractable wheels, water gun, robot controller and associated action figures.

BACKGROUND AND PRIOR ART

Children have been extensively exposed to space/flying ships/vehicles, robots and transformer toys. See U.S. Pat. Nos.: Des. 261,286 to Breneman; Des. 273,406 to Young; Des. 293,806 to Shibukawa; Des. 302,148 to Gogakis; Des. 338,694 to Krebs; 4,211,030 to Morrison et al.; 4,681,554 to Hsien-Yang; 5,190,246 to Mac Conochie; 5,295,890 to Myers; and 5,310,379 to Hippely et al.

However, most of these toys generally fall into one of two categories. These toy vehicles are limited to miniature scale down versions of realistic space shuttles/ships. Alternatively, much of the prior art is composed of scaled down versions of military and hostile ships/vehicles with associated action figures and robots. None of the cited prior art is directed to nonrealistic nor nonmilitary toy vehicles, with robots and associated action figures.

SUMMARY OF THE INVENTION

The first objective of the present invention is to provide a toy vehicle having multiple moving parts including folding wings with projectile launching, slidable roof, raisable upper and rear tail propellers, retractable wheels, rescue harness compartment and a water gun.

The second object of this invention is to provide a toy vehicle operable by a detachable robot with seating space on the vehicle for additional action figures.

The third object of this invention is to provide a nonmilitary and nonrealistic scaled down toy vehicle with associated robot and action figures.

A preferred embodiment is a shuttle toy vehicle for land, air and space applications that holds action figures. The shuttle body has a rectangular configuration, a rear top cover slides from a closed position to an open position exposing a robot pilot control compartment and a crew compartment in the rear end of the shuttle body, a detachable robot pilot having bendable hook and hand arms can be positioned inside the robot pilot control compartment. A front top cover lid rotates from a first closed position to a second raised position exposing a cockpit compartment in the front end of the shuttle body. Retractable wings are positioned on each side of the shuttle body which rotate from a position adjacent to the shuttle body to an extended position substantially perpendicular to the shuttle body. On top of the top cover are a pair of helicopter blades, and a pair of tail stabilizer blades are attached to a rear back wall of the shuttle body. Beneath the shuttle body are four wheels attached in a rectangular pattern with a single wheel beneath the front cockpit. Each wheel has a first retracted position with the wheel outer edges inside of the shuttle body and a second lowered position with the wheel edges contacting ground level. Spring loaded projectile launchers are attached to each of the retractable wings. A water gun has a first water port adjacent a front area of the shuttle body, and a removable piston for insertion into a second port opposite the first port, wherein compressing the piston into the second port causes water to pass out of the first port. A first set of lights is attached to the front of the shuttle body, and a second set of lights located on a rear portion of the shuttle body. A power supply supplies electricity to the first and the second set of lights while an exterior toggle switch turns the power supply on and off. A rear tailgate on the back of the shuttle body accesses a storage compartment. A trap door is located beneath the shuttle body holds an extension line attached to action figure rescue harness.

Further objects and advantages of this invention will be apparent from the following detailed description of a presently preferred embodiment which is illustrated schematically in the accompanying drawings.

BRIEF DESCRIPTION OF THE FIGURES

FIG. 3A is an enlarged bottom view of the Robot pilot of FIG. 1A along arrow D.

FIG. 3B is a perspective view of a single foot wheel of FIG. 3A.

FIG. 3C is a cross-sectional view of the single foot wheel of FIG. 3B.

FIG. 3D is a side view of an alternative foot wheel for use with the bottom of FIG. 3A.

FIG. 8C is a view of the lower portion of vehicle of FIG. 8A with the wheels in a raised position.

FIG. 8D is a perspective view of a single landing wheel housing of FIG. 8A.

FIG. 8E is a side view of the single wheel housing of FIG. 8D along arrow K2.

FIG. 8F is a perspective view of the front single wheel of FIGS. 8A–8C.

FIG. 8G is a side view of the single wheel of FIG. 8F along arrow K4.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figures 1A, 1B, 1C, 1D:
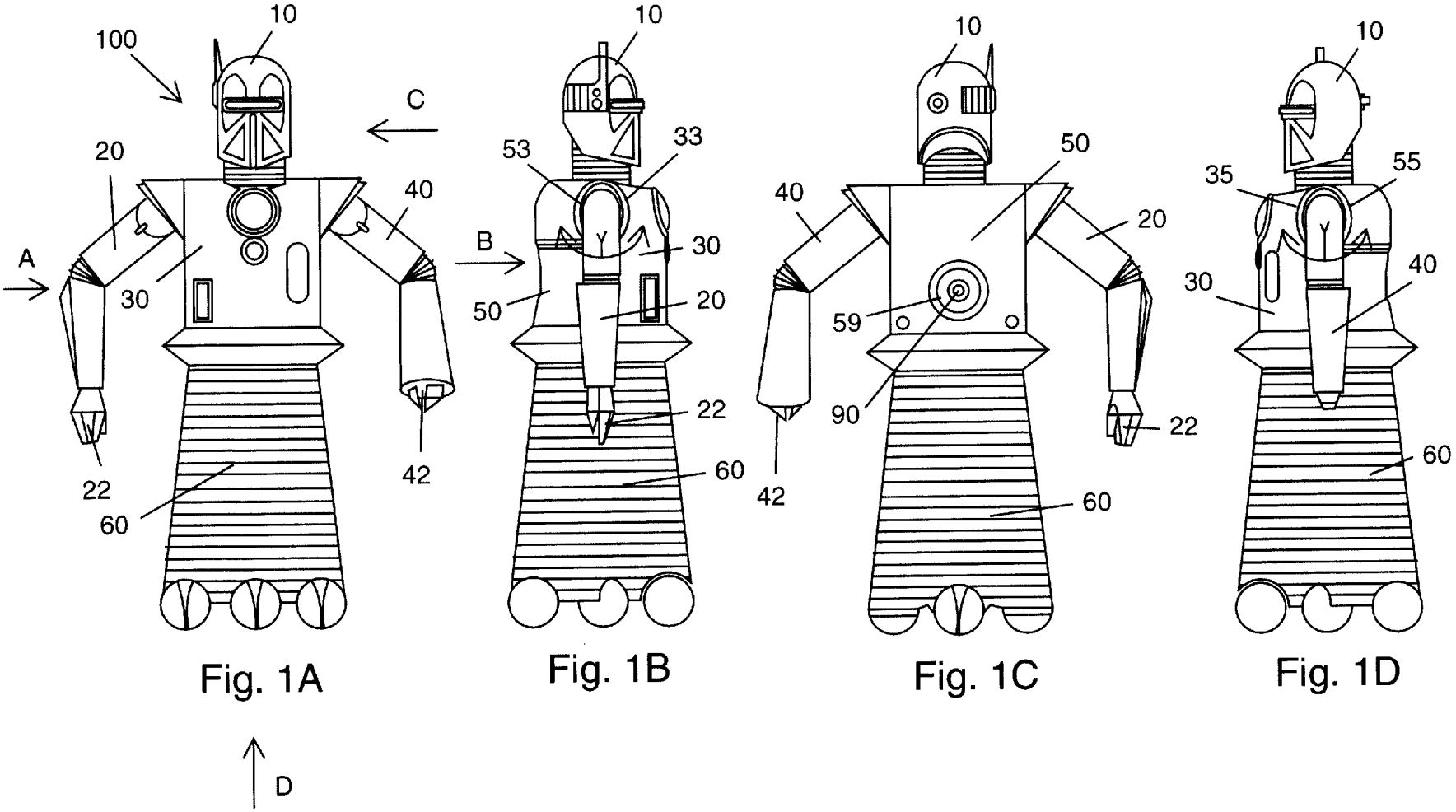
FIG. 1A is a front view of the Robot pilot for use with the subject Van-O-Jet toy vehicle invention.
FIG. 1B is a side view of the Robot pilot of FIG. 1A along arrow A.
FIG. 1C is a rear view of the Robot pilot of FIG. 1B along arrow B.
FIG. 1D is another side view of the Robot pilot of FIG. 1A along arrow C.
Figure 2:
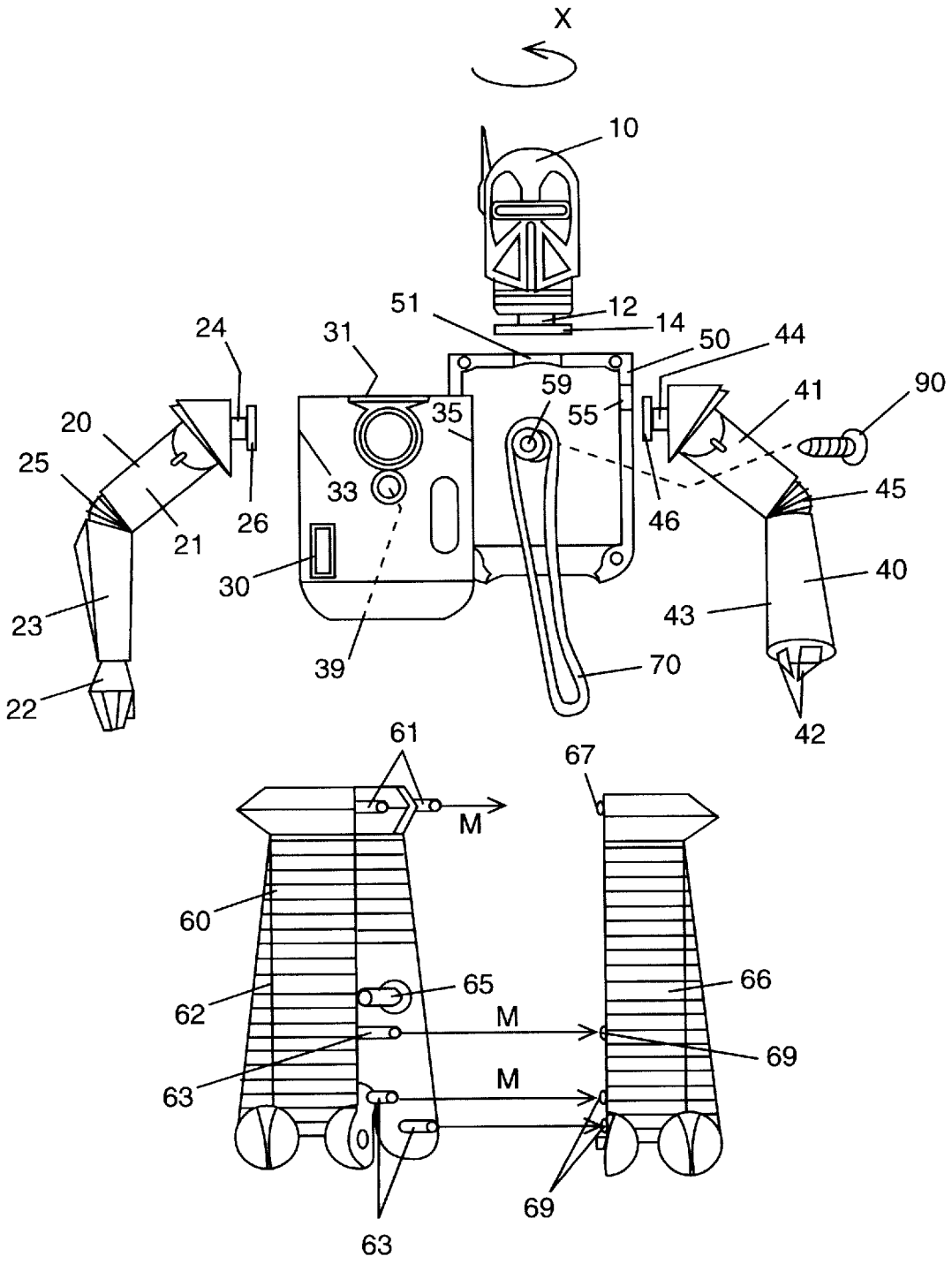
FIG. 2 is an exploded front view of the Robot pilot of FIG. 1A.

FIG. 1A is a front view of the Robot pilot 100. FIG. 1B is a side view of the Robot pilot 100 of FIG. 1A along arrow A. FIG. 1C is a rear view of the Robot pilot 100 of FIG. 1B along arrow B. FIG. 1D is another side view of the Robot pilot 100 of FIG. 1A along arrow C. FIG. 2 is an exploded front view of the Robot pilot of FIG. 1A. Referring to FIGS. 1A–1D, Robot pilot 100 includes head section 10 configured to resemble a knight, front armor appearing breast plate 30, back plate 50, right arm 20 with extended fingers 22, left arm 40 with claw 42, and lower armor appearing torso 60 that each can be preformed separately from injection molded plastic and the like. Alternatively, the entire Robot pilot 100 can be preformed from a single pre-injection molded plastic.

Referring to FIG. 2, head section of Robot pilot 100 has a narrow neck portion 12 and a base portion 14. A socket formed from an upper curved opening 51 in backplate 50 and an opposite upper curved opening 31 forms a collar in front plate 30 allows for head 10 to rotate relative to upper body torso 30, 50 in the either direction of arrow X. A screw 90 fastens through an opening in cylinder 59 of back plate 50 and into mating threads 39 of a preformed nut 39 on the inside of front plate 30. Referring to FIG. 2, right arm 20 includes upper arm portion 21 having a narrow section 24 and base portion 26 which fits within an socket opening 33, 53(shown in FIG. 1B) allowing for right arm 20 to be able to rotate in the direction of arrow Y(see FIG. 1B), and elbow section 25, lower forearm 23 and fingered hand 22. Referring to FIG. 2, left arm 40 includes upper arm portion 41 having narrow section 44 and base portion 46 which fits within a socket opening 35, 55(shown also in FIG. 1D) allowing for left arm 40 to be able to rotate in either way in the direction of arrow Z(see FIG. 1D). Lower torso section 60 can be formed from right half section 62 having plural pegs 61, 63, and left half section 66 having socket section 67, 69 which receive pegs 61, 63 in the direction of arrows M and fixably held in place by glue and the like. A rear peg 65 is used to wrap one end of a rubber band 70, while the opposite end of rubber band wraps about cylinder peg 59. Rubber band 70 connects lower torso 60 to front plate 30 and back plate 50. Referring to FIG. 2, elbow portions 25, 35 of arms 20, 30 can optionally include a bendable material such as a wire and the like in order to be able to allow the arms 20, 30 to be able to rotate at their respective elbows 25, 35.

FIG. 3A is an enlarged bottom view of the Robot pilot 100 of FIG. 1A along arrow D. FIG. 3B is a perspective view of a single foot wheel 92, 94 of FIG. 3A. FIG. 3C is a cross-sectional view of the single foot wheel 92, 94 of FIG. 3B. Referring to FIGS. 3A–3C, each of the four wheels 91 of the Robot pilot 100 includes left sphere half 92 having a protruding socket portion 93 for receiving mating peg 95 of right sphere half 94. A center board 68 projects downward from lower torso 60. Indented areas 61 can be preformed in the bottom of lower torso 60 to which would hold right sphere half 94 and left sphere half 92 together and allow rotation of wheels 91 for frontal movement of the Robot pilot 100. Alternatively, peg 95 and mateable socket portion 93 can be fixably attached to one another by glue and the like. FIG. 3D is a side view of an alternative 360 degree rotatable foot wheel 98 for use with the bottom of FIG. 3A. In FIG. 3D, a castor wheel 98 having a narrow neck portion 97 with socket portion 96 can allow for foot wheel rotation within lower indentation opening 61 of lower torso 60.

Figure 4A:
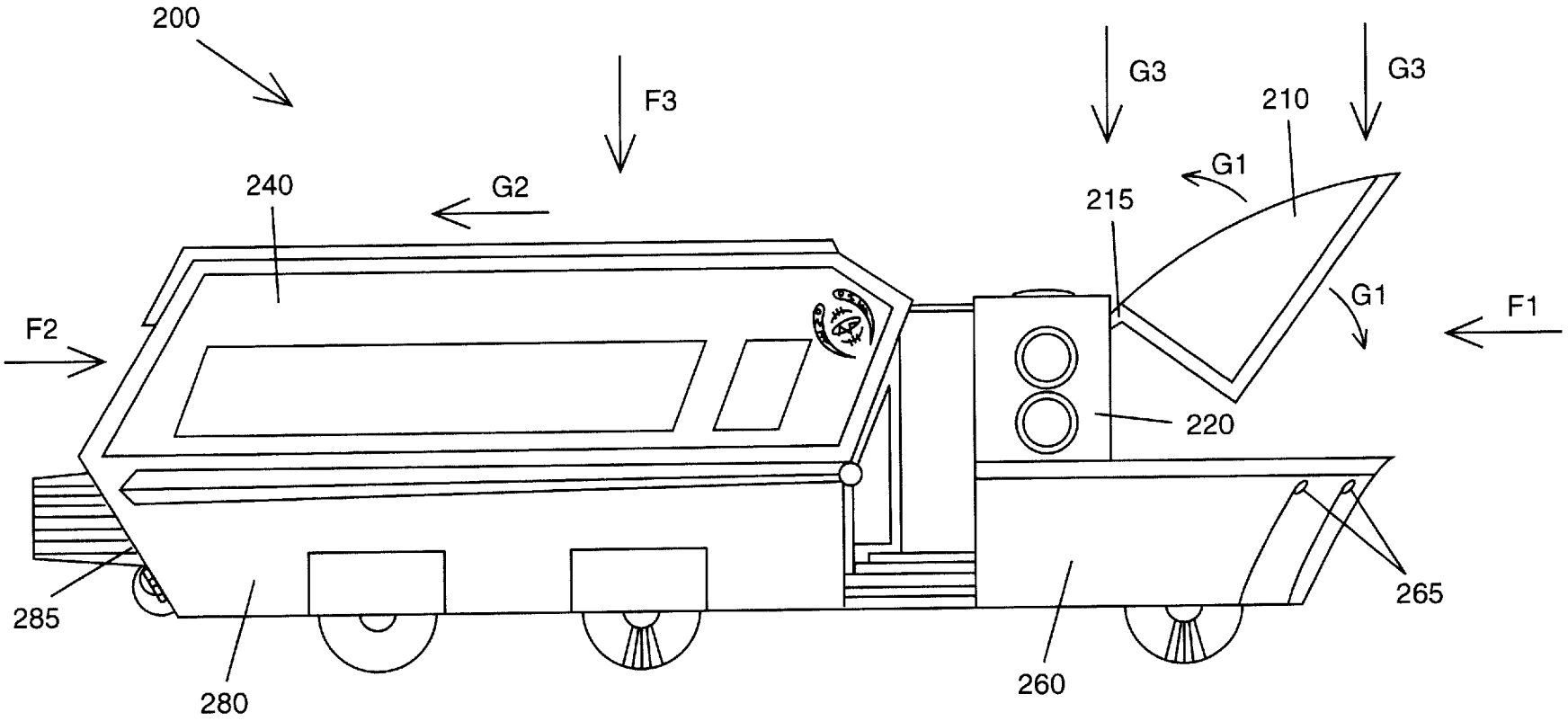
FIG. 4A is a side view of the novel Van-O-Jet toy vehicle.
Figure 4C:
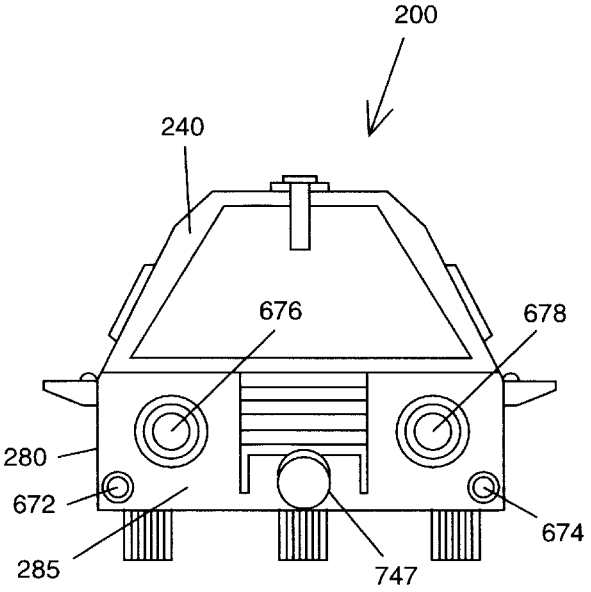
FIG. 4C is a rear view of the novel vehicle of FIG. 4A along arrow F2.
Figure 4B:
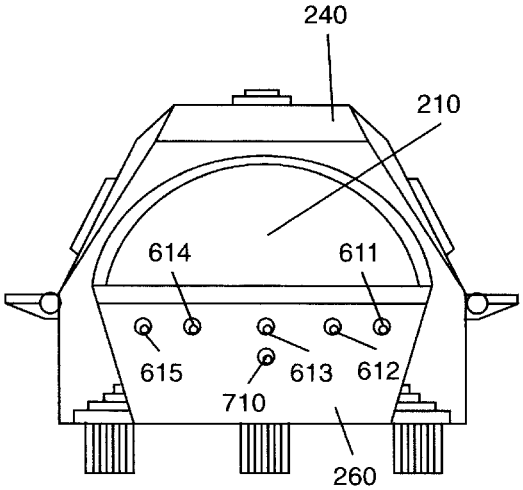
FIG. 4B is a front view of the novel vehicle of FIG. 4A along arrow F1.
Figures 4D, 4E:
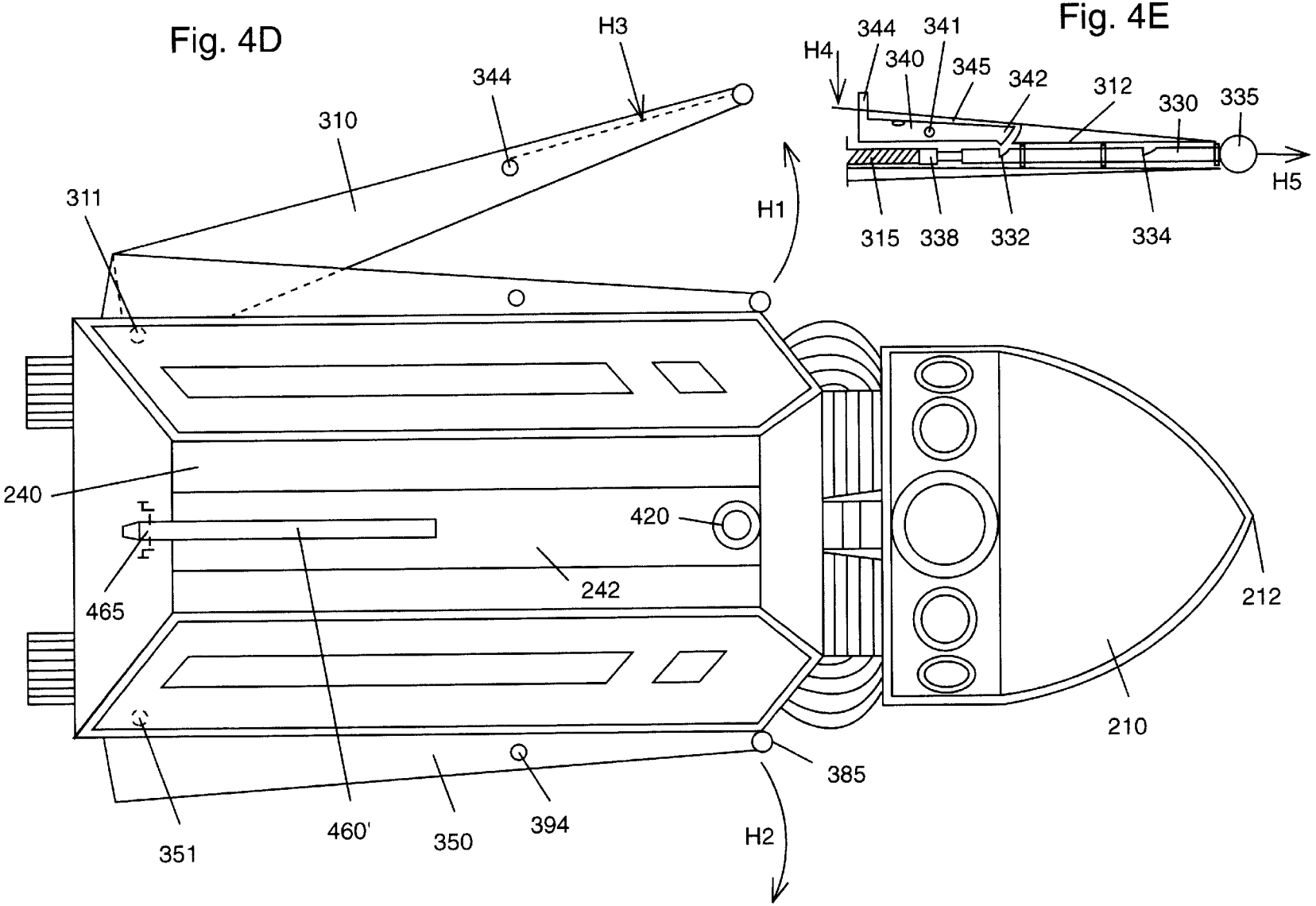
FIG. 4D is a top view of the novel vehicle of FIG. 4A along arrow F3.
FIG. 4E is a cross-sectional view of a wing of FIG. 4D along arrow H3.

FIG. 4A is a side view of the novel Van-O-Jet toy vehicle 200 which can primarily be formed from single pieces of pre-injection molded plastic. FIG. 4B is a front view of the novel vehicle 200 of FIG. 4A along arrow F1. FIG. 4C is a rear view of the novel vehicle 200 of FIG. 4A along arrow F2. FIG. 4D is a top view of the novel vehicle 200 of FIG. 4A along arrow F3. Referring to FIGS. 4A–4D, vehicle 200 includes cockpit shield 210 with nose tip 212 that is raisable in the direction of arrow G1 through a hinge connection 215, and closes to abut against upper portion 220 and lower front portion 260 having light 265(to be described in greater detail later). A slidable shuttle roof cover 240 slides in the direction of arrow G2 over lower rear tail section 280 having rearwardly facing lights 285, all of which will be described in more detail later. The rearward tail propeller 460' with associated components will be discussed in greater detail in reference to FIG. 5A. The lights 611–615, and water gun port 710 shown in FIG. 4B and the light covers 672, 674, 676, 678 and water gun pump end 747 of FIG. 4C will be discussed in greater detail in reference to FIG. 8A.

FIG. 4E is a cross-sectional view of wing 310 of FIG. 4D along arrow H3. Only projectile rod missile 330 and its associated parts are shown in greater detail in a cross-sectional view. Projectile rod 330 is pushed into interior shaft 312 of wing 310 compressing end spring 315. Missile rod 330 has two cut-out side notches 332, 334 that holds the missile rod in place within wing 330 by a mating catch lever tip 342 that is pushed into catch position by an upper spring 345. Catch lever 340 rotates about pivot point 341. Pressing an exterior button 344 down in the direction of arrow H4 causes lever catch tip 342 to separate from a notch 332, 334 resulting in the firing of missile rod 330 in the direction of arrow H5. Wing 350 has a similar projectile missile rod with like components. For purposes of simplification, only missile tip 385 and external press-button 394 are shown.

Figures 4F, 4G:
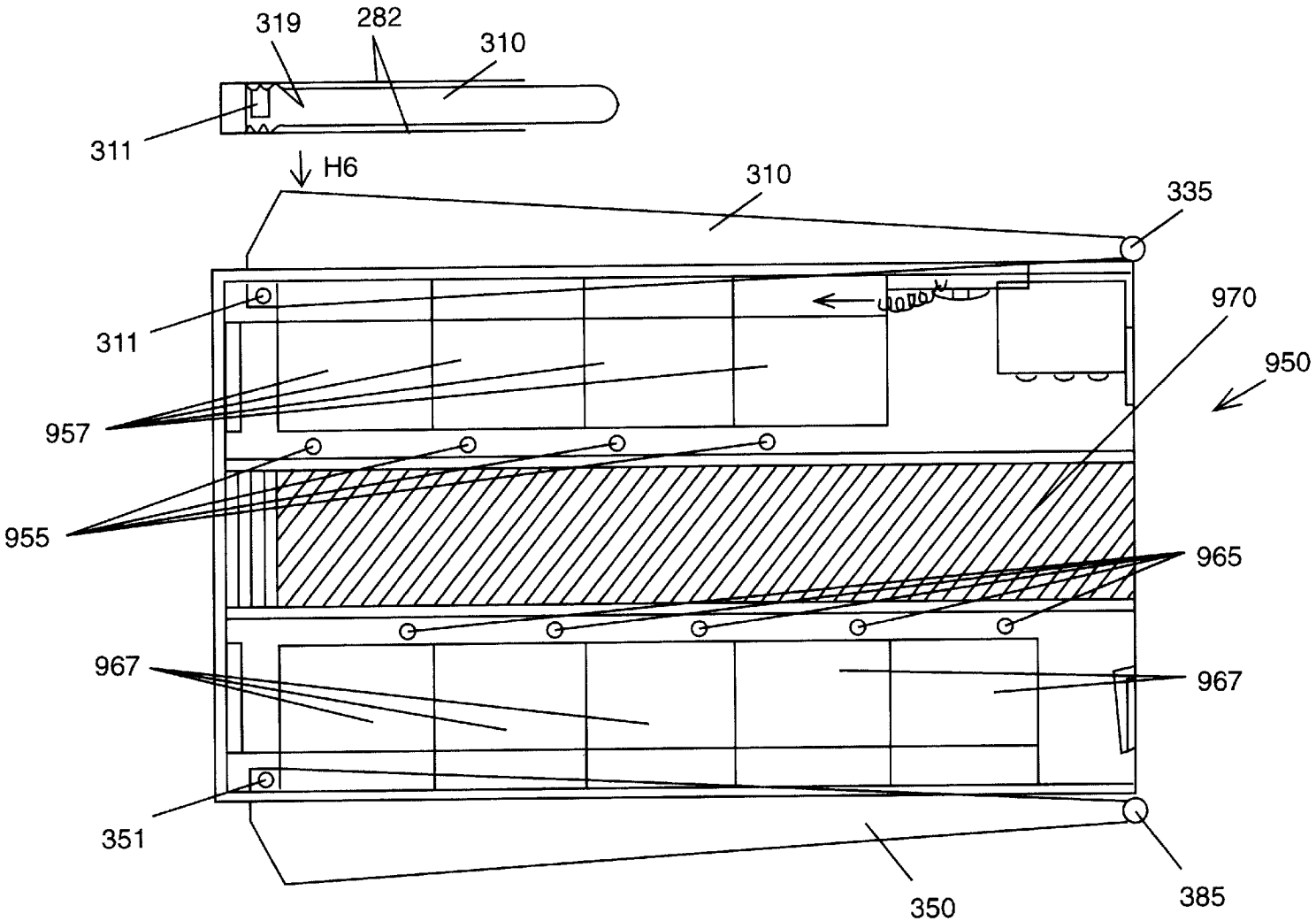
FIG. 4F is a partial top view of the vehicle of FIG. 4D without the shuttle cover.
FIG. 4G is a side view of the wing section of FIG. 4F along arrow H6.

FIG. 4F is a partial top view of the vehicle of FIG. 4D without the shuttle cover. FIG. 4G is a side view of the wing section 310 within slot side opening 282 of lower section 280 of FIG. 4F along arrow H6. Wing 310 can have a roughened grooved side 319 which can keep the wing 310 inside slot 382 when the wing is not extended. Referring to FIGS. 4D, 4F and 4G, dual side wings 310 and 350 can rotate outward in the direction of arrow Hi and H2 relative to pivoting peg connections 311, 351, respectively. Inside each wing 310, 350 are respective projectile rod missiles 330, 380(not shown) having blunted rounded ends 335, 385 which can also be rubber tipped.

Figure 4H:
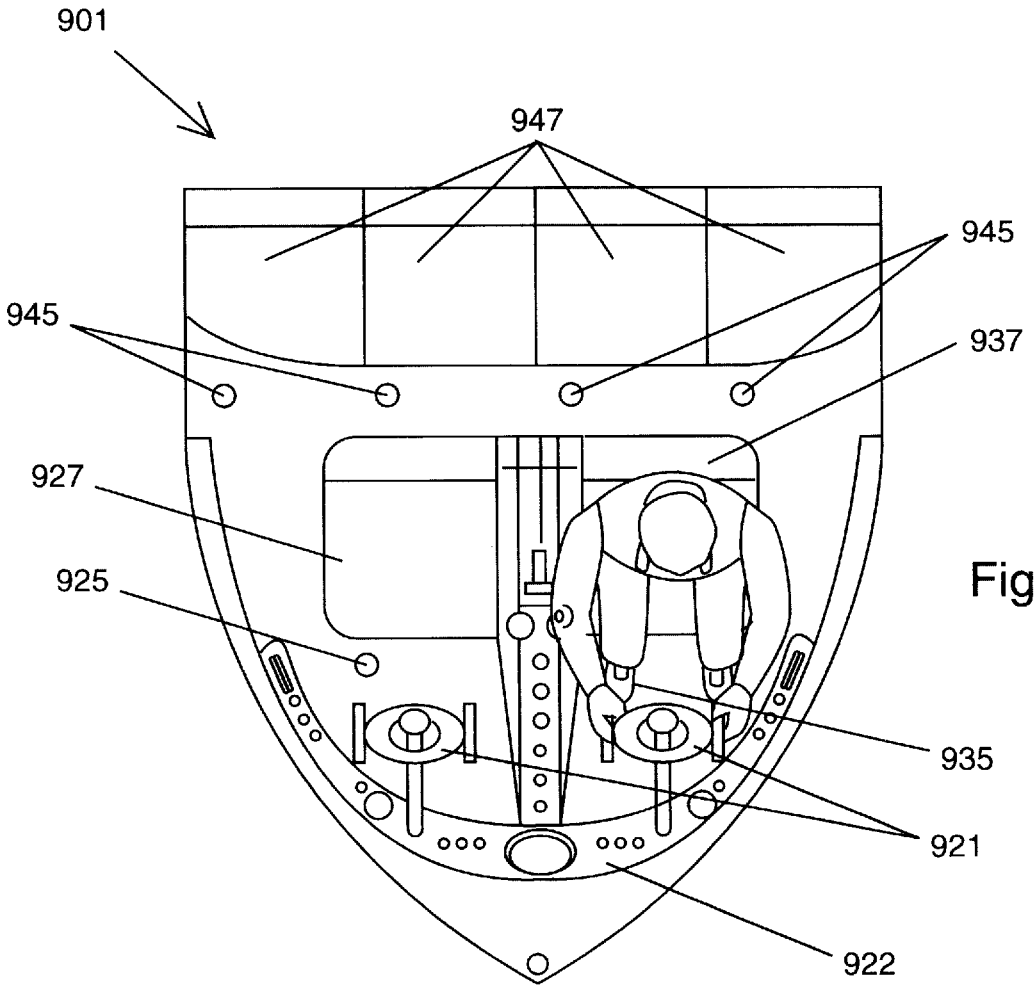
FIG. 4H is a top view of the cockpit compartment of FIG. 4A along arrow G3.
Figure 4I:
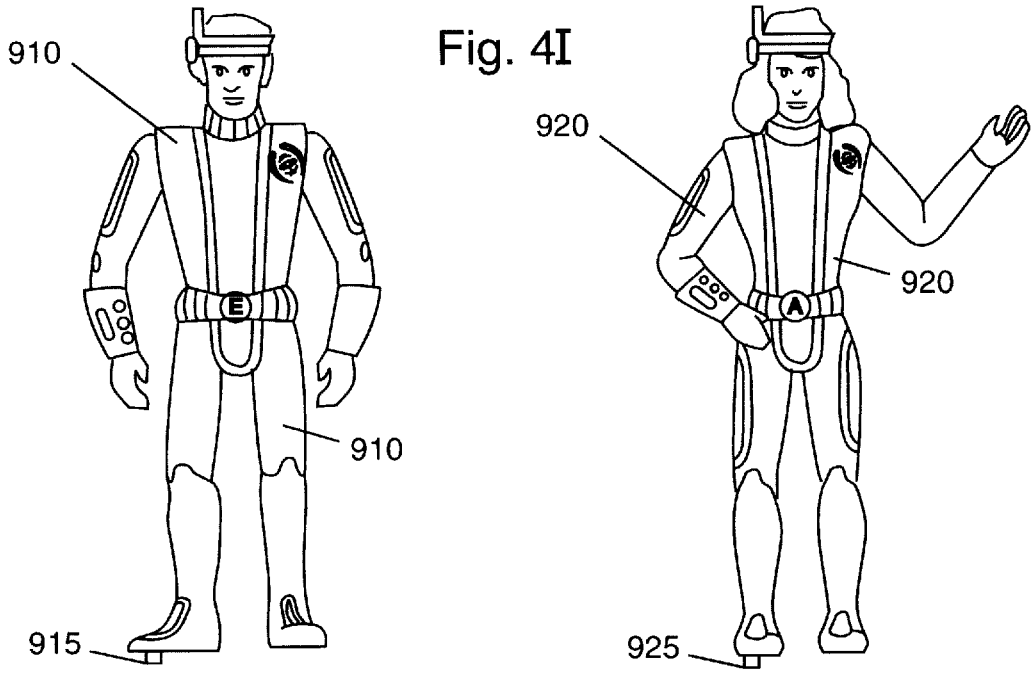
FIG. 4I is a perspective view of bendable action figurines for the vehicle.

FIG. 4H is a top view of the cockpit compartment of FIG. 4A along arrow G3. FIG. 4I is a perspective view of bendable action figurines 910, 920 for the vehicle 200. Referring to FIGS. 4F, 4H and 4I, bendable action figures having premolded rubberized exteriors which can be bendable about wire interiors and single protruding prongs 915, 925 on their right feet. Figurines 910 can be bent into sitting positions so that prongs 915, 925 snapably fit into mateable openings 925, 945, 955, 965 that are on the floor sections 930, 970 in front of various seats 927, 937, 947, 957, 967 of cockpit area 901 and cabin compartment 950, respectively.

Figures 5A, 5B, 5C:
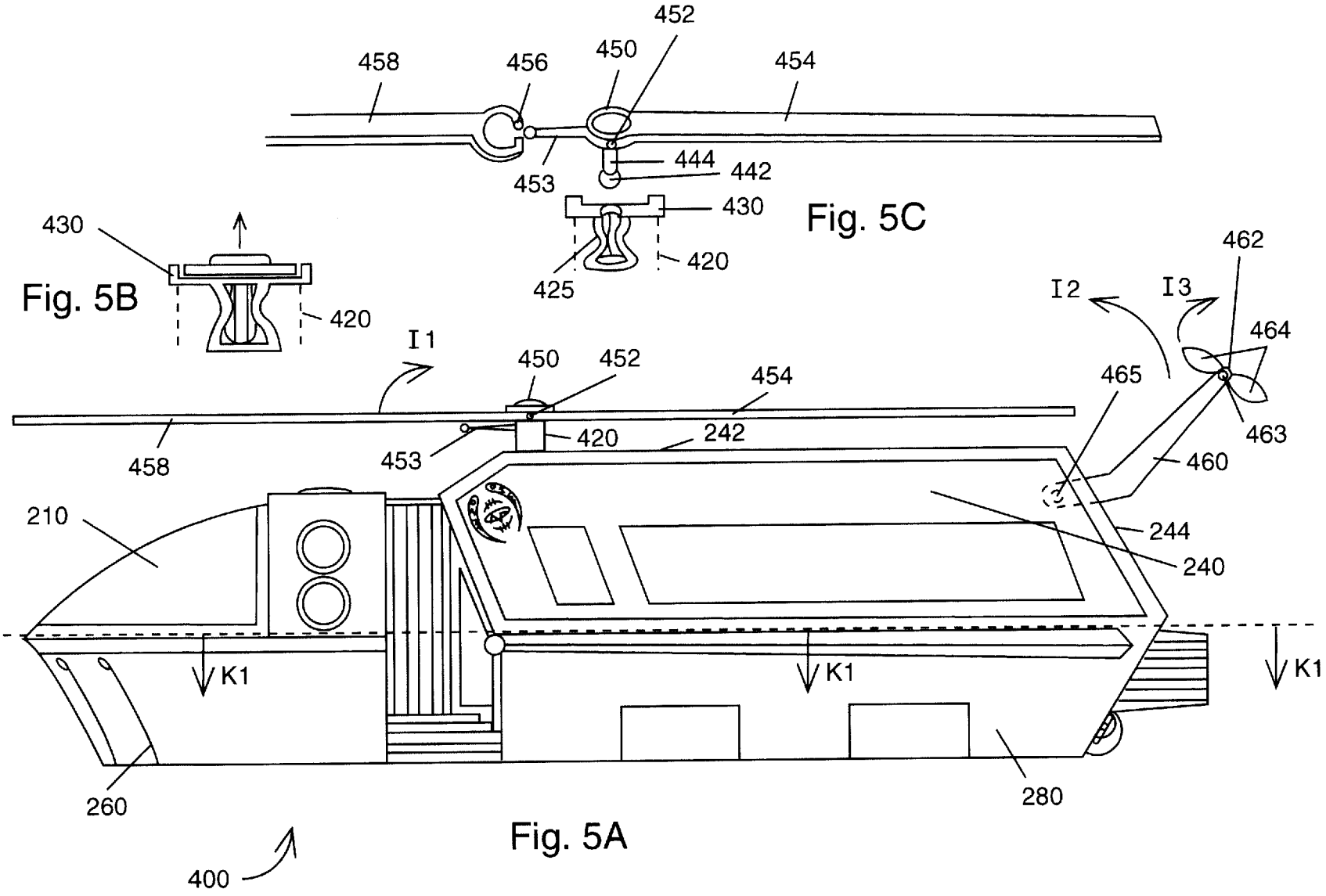
FIG. 5A is a side view of the novel Van-O-Jet toy vehicle with upper propeller blades and tail stabilizer propeller in extended positions and retracted wheels.
FIG. 5B is an enlarged view of the upper propeller blade hub connection.
FIG. 5C is an exploded view of the upper propeller blades and hub connector.

FIG. 5A is a side view of the novel Van-O-Jet toy vehicle 400 with upper propeller blades 454, 458 and tail stabilizer propeller 460 in extended positions and retracted wheels. FIG. 5B is an enlarged view of the upper propeller blade hub 430. FIG. 5C is an exploded view of the upper propeller blades 454,458 and hub connector 420. Referring to FIGS. 5A–5C, cylindrical hub connector 420 is fixably attached to the top 242 of shuttle cover 240(seen more clearly in FIG. 4D). Hub connector 420 includes inner ball socket connector 425 that is sized to fit protruding ball section 442 of extended propeller mount 444 so that ball section 442 is snapably held in place and allows for propeller blades 454, 458 to be able to rotate. To be used ball section 442 snapably fits into socket connector 425 and snapably disengages when not being used. A first main propeller blade 454 connects to a base member 450, that latter having two side holes 452(only one is shown) for supporting the pair of prongs 456 on second main propeller blade 458. When used, second main propeller blade 458 is held level by extension ledge 453 and can be rotated in the direction of arrow I1 about axis 452 to sit above blade 454.

Referring to FIGS. 5A–5C, rear tail stabilizer propeller 460 includes two dual blades 464 connected at a central portion by a protruding axle 462 and to tail extension end 463, where blades 464 can rotate in the direction of arrow I3. The opposite end 465 of tail extension 460 connects to upper side 244 of shuttle roof cover 240. FIG. 4D shows tail stabilizer propeller 460' a closed position.

Figure 6:
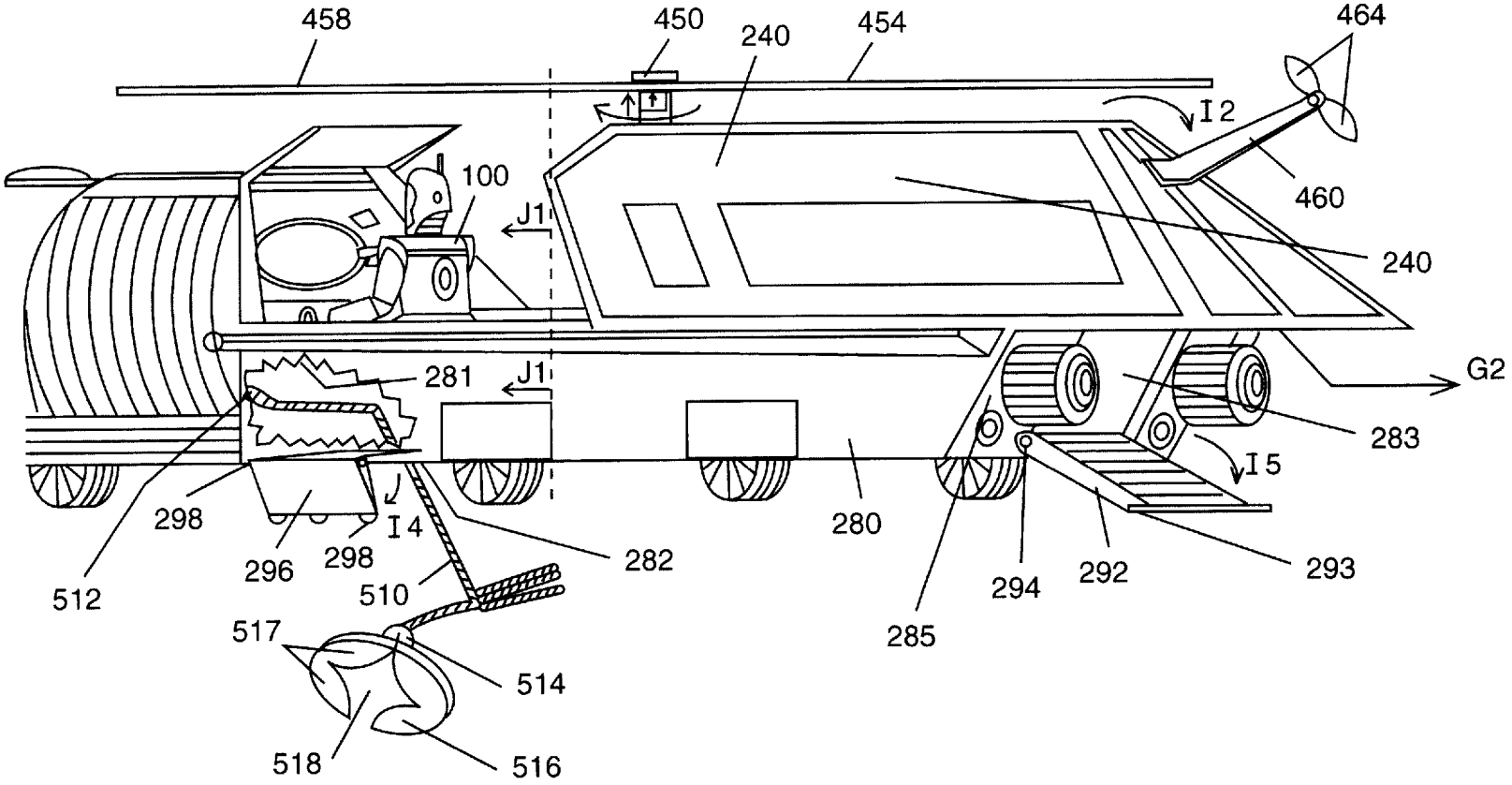
FIG. 6 is a perspective side view of the Van-O-Jet toy vehicle with upper propeller blades and tail stabilizer propeller in extended positions, rescue harness in released position, tail gate in down position, and upper shuttle roof cover slid open.

FIG. 6 is a perspective side view of the Van-O-Jet toy vehicle with upper propeller blades 454, 458 and tail stabilizer propeller 460, 464 in extended positions, rescue harness 516 in released position, tail gate 292 in down position, and upper shuttle roof cover 240 slid open in the direction of arrow G2 exposing the Robot pilot 100 at a console(which win be described later in more detail). Referring to FIG. 6, a lower trap door 296 is rotatably connected by hinge type connections 298 to the underside 282 to swing open in the direction of arrow I4. A snapable connection 298 allows for door 296 to stay closed to the underside 282. A nylon type string rope 510 is connected at one end 512 to the an inside compartment 281(a cross-section is visable to more clearly illustrate the compartment 281). The other end 514 of rope 510 connects to a disc shaped harness 516 having interior curved surfaces 517 with an opening through one side 518. The pliable plastic harness 516 can be used to wrap about the mid portions of associated action figurines 910, 920(shown and described in more detail later). A rear gate 292 can fold down in the direction of arrow 15 and is connected at one end 294 by a hinge connection, the opposite end 293 has a snapable connection 293 that allows the rear door 292 to stay closed over compartment 283.

Figure 7A:
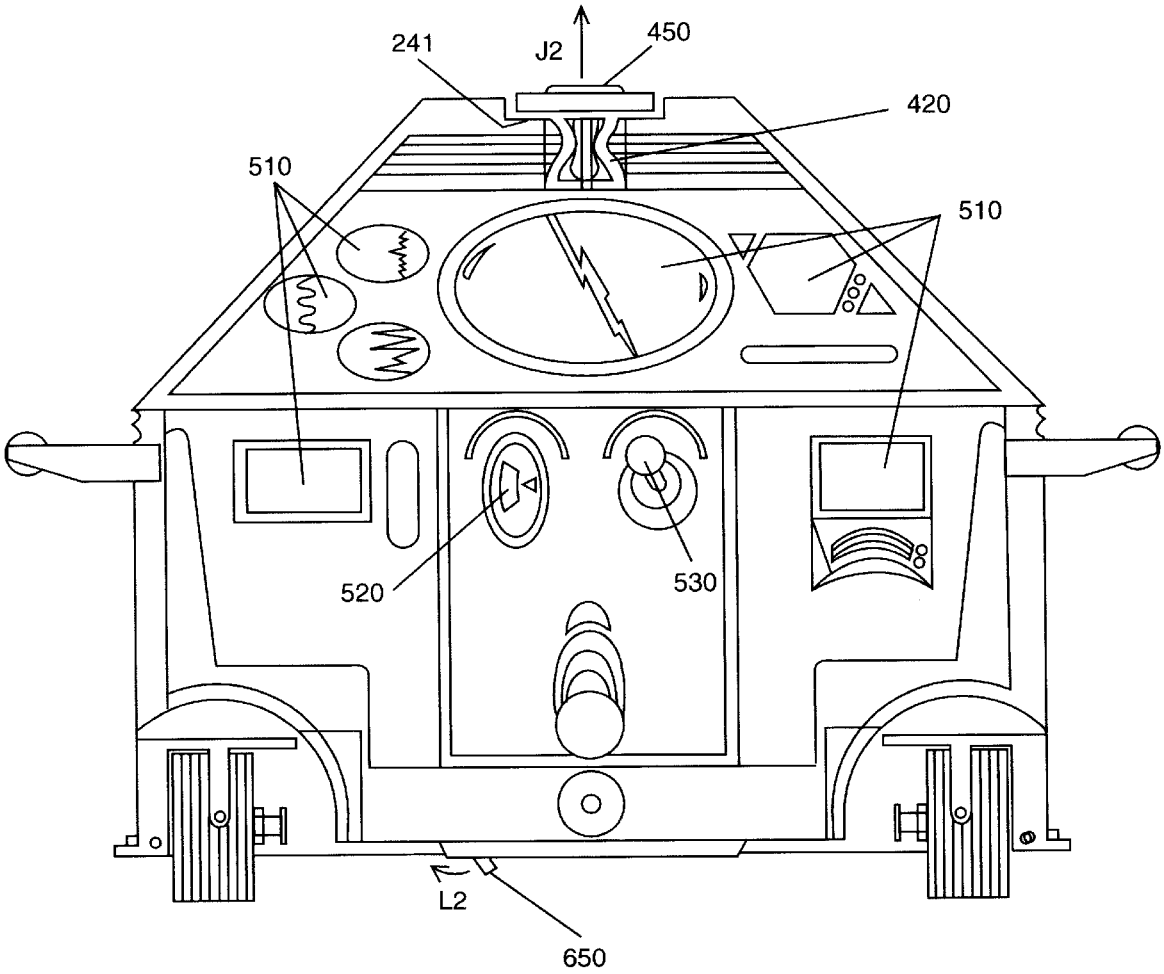
FIG. 7A is a cross-sectional view of the vehicle of FIG. 6 along arrow J1 without the Robot pilot with the shuttle cover in a closed position.
Figure 7B:
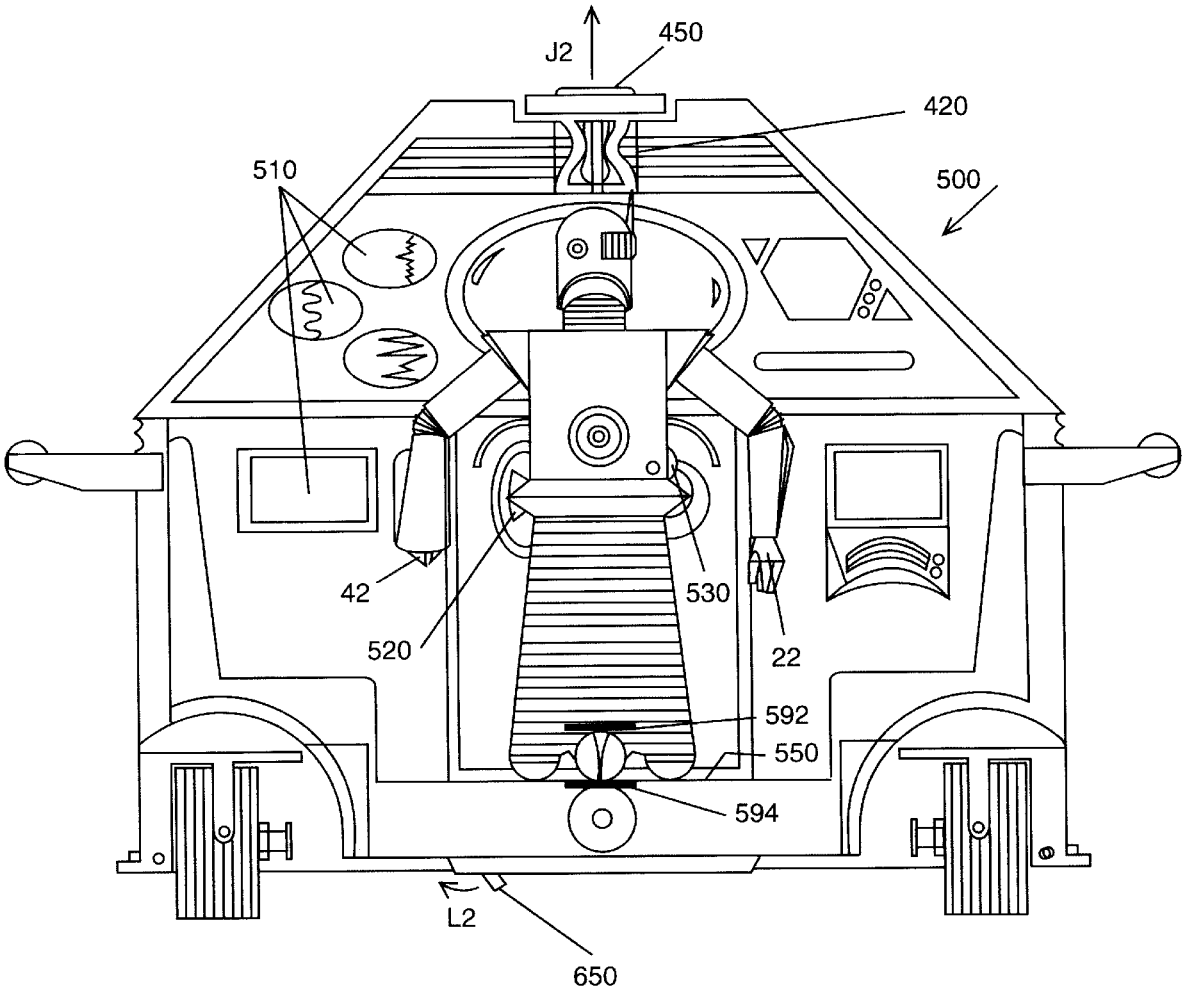
FIG. 7B is a cross-sectional view of the vehicle of FIG. 6 along arrow J2 with the Robot pilot with the shuttle cover in a closed position.

FIG. 7A is a cross-sectional view of the vehicle of FIG. 6 along arrow J1 without the Robot pilot and the shuttle cover 240 in a closed position. Note that hub 420 can optionally be pushed down into a cylindrical slot opening 241 in the top of shuttle cover 242 when propeller blades 458, 454 are folded over one another. Console panel area 500 includes sticker decals 510 that can depict vehicle gages such as but not limited to fuel, time, operating parameter decals(oil, temperature,) and the like, with an insert control opening 520 and an extended protruding joy stick knob 530. FIG. 7B is a cross-sectional view of the vehicle of FIG. 6 along arrow J2 with the Robot pilot 100 present and the shuttle cover 240 in a closed position. Claw hand 42 of Robot pilot 100 can be bent to fit into control panel opening 520 of the control panel 500 and hand fingers 22 can be positioned about joy stick knob 530. Optionally, the Robot pilot 100 can include a first magnet 592 attached to the Robot pilot 100 and a matching magnet 594 fixably attached to the floor 550 of control panel area 500.

Figure 8A:
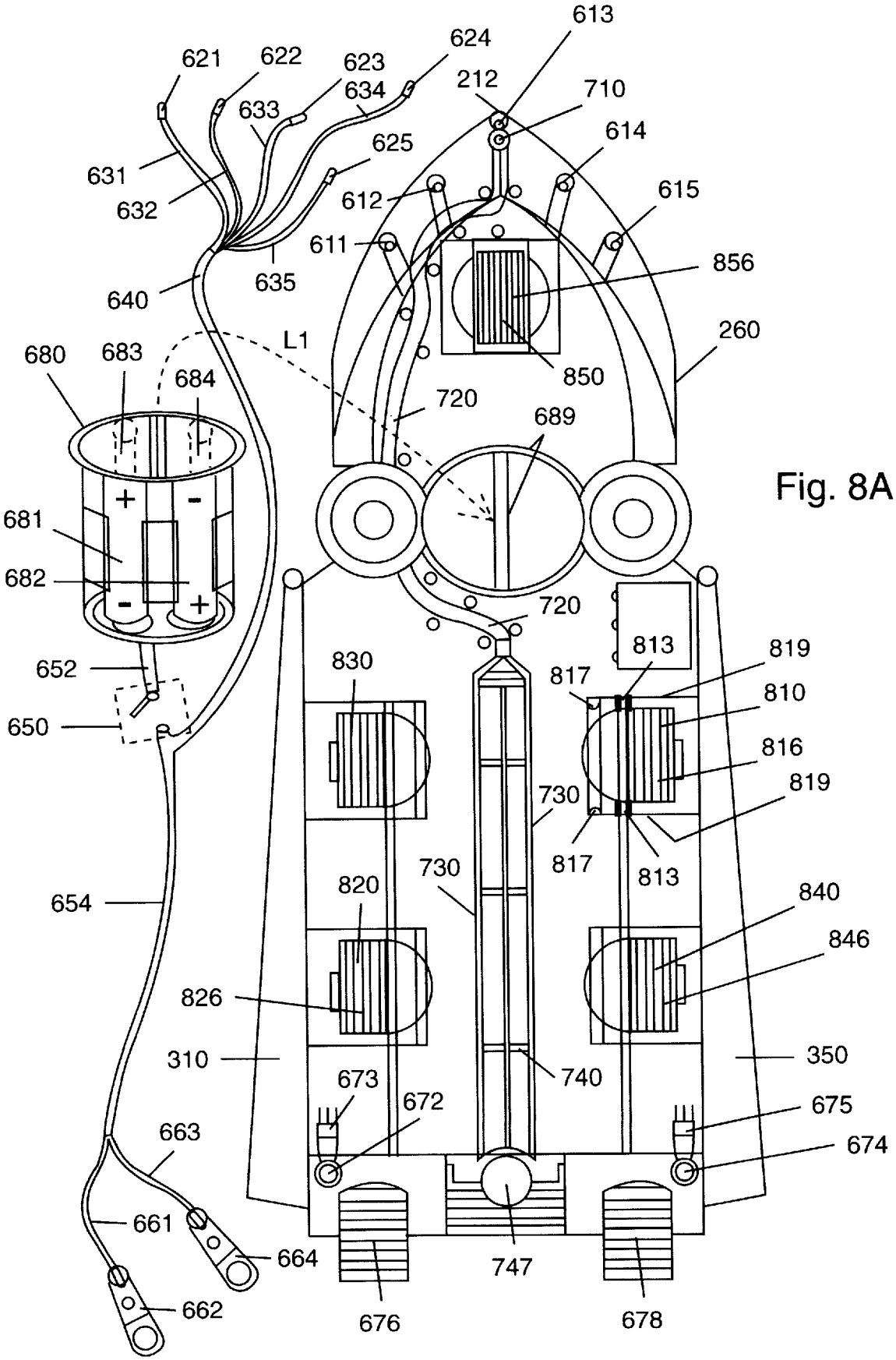
FIG. 8A is a cross-sectional view of the lower portion of vehicle of FIG. 5A along arrow K1 with the battery pack separated therefrom, the water gun in a compressed/fire position, and the wheels in a lowered position.
Figure 8B:
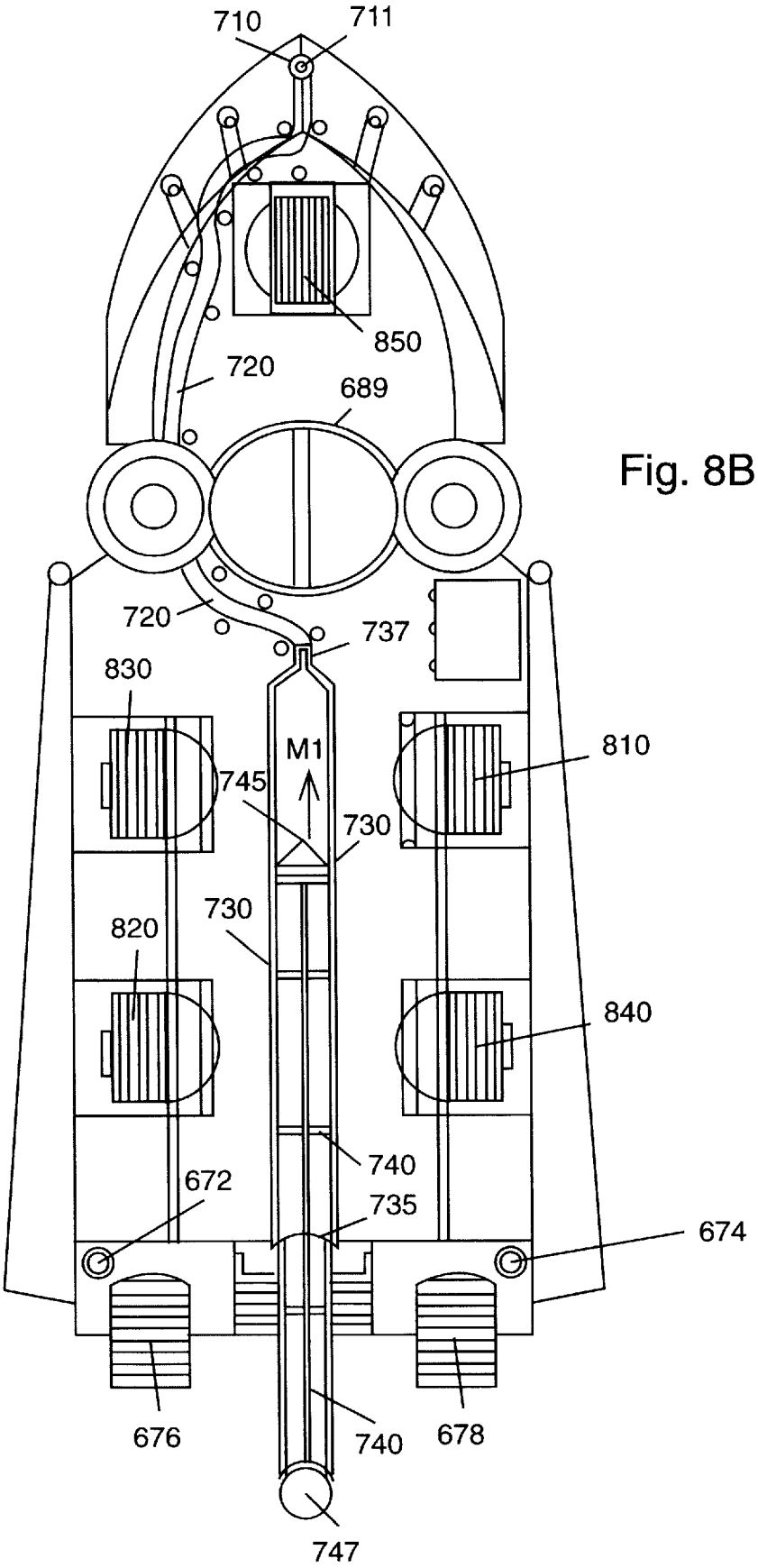
FIG. 8B is a cross-sectional view of the lower portion of vehicle of FIG. 5A along arrow K1 with the water gun in a ready-to-fire position.

FIG. 8A is a cross-sectional view of the lower portion of vehicle of FIG. 5A along arrow K1 with the battery pack 680 separated therefrom, the water gun in a compressed/fire position, and the wheels in a lowered position. FIG. 8B is a cross-sectional view of the lower portion of vehicle of FIG. 5A along arrow K1 with the water gun in a ready-to-fire position.

The electrical system will be described in reference to FIG. 8A, 7A, 7B, 4B and 4C. A cylindrical battery pack 680 can include approximately four AA batteries 681, 682, 683, 684 housed therein which is sized to fit within mating cylindrical socket 689. Battery powerpack 680 is connected to front lights wire 640 through lead wires 631, 632, 633, 634, 635 and to respective miniature bulb lights 621, 622, 623, 624, 625, respectively which are visable through respective front portals 611, 612, 613, 614, 615 of lower front 260 of the novel vehicle. Rear lights wire 654 connects battery power by wire leads 661, 662 & 663, 664, to rear miniature light bulbs 673, 674 which are covered by yellow or red colored lens covers 672, 673. Optionally, the Red or Yellow covered lens covers 676, 678 shown in FIG. 4C can also be lighted by additional bulbs in a like manner. An external toggle on/off switch 650, FIG. 8A, can be pushed in the direction of arrow L2 (see FIG. 7A, 7B) to turn on and off all external lights 621–625, 673, and 675.

The water gun 730 will now be discussed in reference to FIGS. 4B, 4C, 8A and 8B. An injection pump 740 has a ball tipped handheld exterior end 747 and a piston tip end 745 which moves inside cylindrical housing 730 in the direction of arrow Ml. When filling the cylindrical housing 730, the entire injection pump 740 with handheld end 747 and piston end 745 are totally removed therefrom. Water is then gravity passed into end 735 of cylindrical housing 730. Pushing end 747 causes piston tip end 745 to compress and pass water through narrowing tip 737 into hose line 720 and out water gun port 710. A small rubber type disc flap 711 formed from an O-ring and the like, having a perforated hole can seal port 710 when the water gun is not in use.

FIG. 8C is a view of the lower portion of vehicle of FIG. 8A with the wheels 816', 826', 836', 846', 856' in a raised position. FIG. 8D is a perspective view of a single landing wheel housing 810 of FIG. 8A. FIG. 8E is a side view of the single wheel housing 810 of FIG. 8D along arrow K2, where the wheel 816 is lifted to its raised position by rotating in the direction of arrow K3. FIG. 8F is a perspective view of the front single wheel of FIGS. 8A–8C. FIG. 8G is a side view of the single wheel of FIG. 8F along arrow K4. Each of the wheel housings 810, 820, 830 and 840 contain similar rubber edged plastic wheels 816, 826, 836, 846 and identical components that allow for the raising and lowering of landing wheels. Thus, a description of wheel housing 810 will suffice for the operation of wheel housings 820, 830 and 840. Wheel 816 is held in place by blunted end axle pin 818 which holds wheel 816 adjacent to side wall 814. Protruding prongs 813(only one is shown in FIGS. 8D, 8E) on opposite edges of wheel 816 connect to housing 810 by overlaping side walls 812(one is shown). Prongs 813 permanently attach in inner walls 819 so that wheel housing 810 can rotate from an lowered position(FIG. 8E) in the direction of arrow K3 to a raised position 816' shown in FIG. 8C. Protruding bumps 815 and 817 frictionally rubs against inner wall 819 in order to hold wheel housing 810 in both the lowered and raised positions. Single front wheel housing 850 includes a single rubber edged plastic wheel having parallel side plates 859 on both sides and an axle 851 therebetween. Prongs 853 on opposite ends of the plates 859 rotatably sit within mateable openings in side walls 851 to allow wheel 856 to rotate in either direction from a raised to a lowered position and vice versa. Bumps 852 on side ends of parallel plates rub against inner walls 851 to hold wheel housing 850 in both the raised and lowered positions.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A shuttle toy vehicle for land, air applications that holds action figures comprising:

a shuttle body having a rectangular configuration having a front end and a rear end;

a rear top cover for sliding from a closed position to an open position exposing a crew compartment in the rear end of the shuttle body;

a front top cover lid for rotating from a first closed position to a second raised position exposing a cockpit compartment in the front end of the shuttle body;

a pair of helicopter blades connected on top of the rear top cover;

a pair of tail stabilizer blades attached to a rear back wall of the shuttle body;

a hinge for allowing one helicopter blade for overlying above a second helicopter blade;

an extended tail member having a first end connected to the stabilizer blades, and a second end rotatable connected to a back surface of the rear top cover, wherein the extended tail member can be stored inside the rear top cover; and a first retractable wing on one side of the shuttle body that rotates in a horizontal plane from a position adjacent to the shuttle body to an extended position substantially perpendicular to the shuttle body; and a second retractable wing on a second side of the shuttle body, opposite the one side, the second retractable wing rotates in the horizontal plane from a position adjacent to the shuttle body to an extended position substantially perpendicular to the shuttle body, wherein the crew compartment and the cockpit compartment hold action figures.

2. The shuttle toy vehicle of claim 1, further comprising:

a projectile launcher attached to an outer edge of at least one of the retractable wings; and a projectile for insertion into the launcher.

3. The shuttle toy vehicle of claim 1, further comprising:

at least three wheels attached to a lower surface of the shuttle body;

each wheel having an first retracted position with the wheel outer edges inside of the shuttle body and a second lowered position with the wheel edges contacting ground level.

4. The shuttle toy vehicle of claim 3, further including:

four wheels arranged in a rectangular pattern beneath the rear slidable top cover; and a single front wheel positioned beneath and the cockpit compartment.

5. The shuttle toy vehicle of claim 1, further comprising:

a first set of lights on a front portion of the shuttle body;

a second set of lights located on a rear portion of the shuttle body;

a power supply for supplying electricity to the first and the second set of lights; and a exterior switch for turning the power supply on and off.

6. The shuttle toy vehicle of claim 1, further comprising:

a robot action figure having raisable and lowerable arms; and a base portion for connecting to an inside mount within the vehicle.

7. The shuttle toy vehicle of claim 6, further comprising:

a first magnet attached to the base portion of the robot pilot; and a second magnet attached to the inside mount, wherein the first magnet is attracted to the second magnet to hold the robot pilot inside the shuttle body.

8. The shuttle toy vehicle of claim 1, further comprising:

first seat means inside the cockpit compartment; and second seat means inside the crew compartment, wherein the first and the second seat means seats the action figures.

9. The shuttle toy vehicle of claim 8, further comprising:

openings in floors of the of the cockpit compartment and the crew compartment; and protrusions extending beneath one foot of each of the action figures, wherein the protrusions fit into the openings in the floors for allowing the action figures to remain in the first and the second seat means.

10. The shuttle toy vehicle of claim 1, further comprising:

a rear tailgate rotatably attached to a back of the shuttle body which opens and closes a storage compartment.

11. The shuttle toy vehicle of claim 1, further comprising:

a trap door located beneath the shuttle body for accessing an inner compartment; and a harness connected to one end of an extension line and a second end of the extension line connected to a location inside the inner compartment.

12. The shuttle toy vehicle of claim 11, wherein the harness further includes:

a disc shape having inner curved walls and a side opening sized to fit about and grasp one of the action figures.

13. A land, air and outerspace shuttle toy vehicle for holding action figures comprising:

a shuttle body having a rectangular configuration having a front end and a rear end;

a rear top cover for sliding from a closed position to an open position exposing a robot pilot control compartment and a crew compartment in the rear end of the shuttle body;

a front top cover lid for rotating from a first closed position to a second raised position exposing a cockpit compartment in the front end of the shuttle body;

a first retractable wing on one side of the shuttle body that rotates in a horizontal plane from a position adjacent to the shuttle body to an extended position substantially perpendicular to the shuttle body;

a second retractable wing on a second side of the shuttle body, opposite the one side, the second retractable wing rotates in the horizontal plane from a position adjacent to the shuttle body to an extended position substantially perpendicular to the shuttle body, wherein the crew compartment and the cockpit compartment hold action figures;

a first water port adjacent a front area of the shuttle body; and a removable piston for insertion into a second port opposite the first port, wherein compressing the piston into the second port causes water to pass out of the first port.

14. The land, air and space shuttle toy vehicle of claim 13, further comprising:

a projectile launcher attached to an outer edge of at least one of the retractable wings; and a projectile for insertion into the launcher.

15. The land, air and space shuttle toy vehicle of claim 13, further comprising:

a first set of lights on a front portion of the shuttle body;

a second set of lights located on a rear portion of the shuttle body;

a power supply for supplying electricity to the first and the second set of lights; and a exterior switch for turning the power supply on and off.

16. A land, air and outerspace shuttle toy vehicle for holding action figures comprising:

a shuttle body having a rectangular configuration having a front end and a rear end;

a rear top cover for sliding from a closed position to an open position exposing a robot pilot control compartment and a crew compartment in the rear end of the shuttle body;

a detachable robot pilot positioned inside the robot pilot control compartment;

a front top cover lid for rotating from a first closed position to a second raised position exposing a cockpit compartment in the front end of the shuttle body;

a first retractable wing on one side of the shuttle body that rotates from a position adjacent to the shuttle body to an extended position substantially perpendicular to the shuttle body;

a second retractable wing on a second side of the shuttle body, opposite the one side, the second retractable wing rotates from a position adjacent to the shuttle body to an extended position substantially perpendicular to the shuttle body, wherein the crew compartment and the cockpit compartment hold action figures;

a pair of helicopter blades connected on top of the rear top cover;

a pair of tail stabilizer blades attached to a rear back wall of the shuttle body;

at least three wheels attached to a lower surface of the shuttle body, wherein each wheel has a first retracted position with the wheel outer edges inside of the shuttle body and a second lowered position with the wheel edges contacting ground level;

a projectile launcher attached to an outer edge of at least one of the retractable wings;

a projectile for insertion into the launcher;

a first water port adjacent a front area of the shuttle body;

a removable piston for insertion into a second port opposite the first port, wherein compressing the piston into the second port causes water to pass out of the first port;

a first set of lights on a front portion of the shuttle body;

a second set of lights located on a rear portion of the shuttle body;

a power supply for supplying electricity to the first and the second set of lights; and a exterior switch for turning the power supply on and off;

a rear tailgate rotatably attached to a back of the shuttle body which opens and closes a storage compartment;

a trap door located beneath the shuttle body for accessing an inner compartment; and a harness connected to one end of an extension line and a second end of the extension line connected to a location inside the inner compartment.

* * * * *